United States Patent [19]

Johnson, Jr. et al.

[11] 4,206,726

[45] Jun. 10, 1980

[54] DOUBLE ORIFICE PISTON COOLING NOZZLE FOR RECIPROCATING ENGINES

[75] Inventors: John L. Johnson, Jr., Brimfield; Robert M. Vize, Moline; Noel D. Wiggins, Chillicothe, all of Ill.

[73] Assignee: Caterpillar Tractor Co., Peoria, Ill.

[21] Appl. No.: 816,782

[22] Filed: Jul. 18, 1977

[51] Int. Cl.[2] ..... F01P 3/08

[52] U.S. Cl. ..... 123/41.35; 123/41.36; 210/168; 239/600; 92/173; 92/186

[58] Field of Search ..... 123/41.36, 41.35, 41.34; 92/173, 186; 210/168; 239/600

[56] References Cited

U.S. PATENT DOCUMENTS

| | | | |
|---|---|---|---|
| 1,612,372 | 12/1926 | Gussman | 123/41.35 |
| 1,747,935 | 2/1930 | Hemmingsen | 239/600 |
| 1,835,047 | 12/1931 | Hill | 210/168 X |
| 2,753,216 | 7/1956 | Wirsching | 239/600 |
| 2,788,773 | 4/1957 | Meurer | 123/41.35 |
| 2,800,119 | 7/1957 | Schmidl | 123/41.35 |
| 3,189,010 | 6/1965 | Isley | 92/186 X |
| 3,709,109 | 1/1973 | Howe | 123/41.35 X |
| 3,879,940 | 4/1975 | Stenger et al. | 239/600 |
| 4,010,718 | 3/1977 | Stewart | 123/41.36 X |
| 4,067,307 | 1/1978 | Hofle | 123/41.35 |

FOREIGN PATENT DOCUMENTS

| | | | |
|---|---|---|---|
| 178237 | 4/1954 | Fed. Rep. of Germany | 123/41.35 |
| 2428451 | 1/1976 | Fed. Rep. of Germany | 123/41.36 |
| 2532132 | 2/1977 | Fed. Rep. of Germany | 123/41.34 |
| 493608 | 5/1919 | France | 123/41.35 |
| 952768 | 5/1949 | France | 123/41.35 |
| 728819 | 4/1955 | United Kingdom | 239/600 |
| 504883 | 5/1976 | U.S.S.R. | 123/41.35 |

*Primary Examiner*—Charles J. Myhre
*Assistant Examiner*—Jeffrey L. Yates
*Attorney, Agent, or Firm*—Wegner, Stellman, McCord, Wiles & Wood

[57] ABSTRACT

A reciprocating engine including a block having at least one cylinder therein, a piston reciprocally received in the cylinder and having a crown, a depending skirt and a ring-receiving groove on the skirt near the crown. The piston has a central cavity terminating near the crown and a coolant-receiving passage in heat exchange relationship to the groove. A nozzle is stationarily mounted on the engine and has first and second jets, the first jet directing coolant to the cavity and the second jet directing coolant to the coolant-receiving passage, both for all operating positions of the piston within the cylinder. A filtered oil supply for the nozzle is provided.

6 Claims, 6 Drawing Figures

110
46
16
38
40
52
42
14
44
38
50
54
36
32
26

20
12
24
22
36
28

34
10
30
110
40
44
38
80
52
54
26
84
32
82
50
42

DOUBLE ORIFICE PISTON COOLING NOZZLE FOR RECIPROCATING ENGINES

BACKGROUND OF THE INVENTION

This invention relates to reciprocating engines employing oil-cooled pistons.

Many engines in use today employ oil-cooled pistons for known reasons. In some such pistons, there is an annular passage in proximity to the ring-receiving grooves having a downwardly open port. A nozzle is located below the cylinder receiving the piston and in alignment with the inlet port for spraying oil upwardly into the piston to be received in the annular passage and cool the piston in the vicinity of the rings. Consequently, the rings are cooled with the result that a thicker oil film is developed at the interface between the rings and the cylinder wall providing better lubrication qualities.

Others merely direct a spray of oil to the interior of the piston crown for cooling purposes.

In the case of the former type, precise alignment of the nozzle with the inlet port is required since the nozzle will be stationary while the piston will be moving and it is desired to direct oil to the annular coolant passage at all times. In the case of the latter, wrist pin receiving bosses as well as the wrist pin and, when the piston is moved upwardly within the cylinder and away from the spray, the connecting rod interfere with the spray pattern and can prevent, at various times in the cycle, the coolant from reaching all interior surface parts of the piston, resulting in localized hot spots which can lead to cracking of the piston.

In many cases, because of the precise alignment of the sprays with the piston parts, servicing is difficult, often requiring disassembly of engine parts such as the crank shaft, bearing, etc.

SUMMARY OF THE INVENTION

The present invention is directed to overcoming one or more of the above problems.

According to one aspect of the invention, there is provided a reciprocating engine including a block having a cylinder therein. A piston is reciprocally received in the cylinder and has a crown, a depending skirt and a ring-receiving groove on the skirt near the crown. The piston also includes a central cavity terminating near the crown and coolant-receiving means in heat exchange relationship to the groove. A nozzle is stationarily mounted on the engine and has first and second jets, the first jet directing coolant to the cavity and the second jet directing coolant to the coolant-receiving means, both for all operating positions of the piston within the cylinder. Means are provided for supplying oil to the nozzle to act as a coolant.

In a highly preferred form of an engine made according to the invention as described in the immediately preceding paragraph, the first and second jets are at an acute angle with respect to each other and the first jet is at an angle with respect to the longitudinal axis of the cylinder to cause coolant emanating therefrom to sweep along the cavity and avoid interference with engine parts. The second jet is generally parallel to the longitudinal axis.

According to another aspect of the invention, the engine has a block which is described above with an exterior surface and a piston is disposed within the cylinder. A bore extends through the block from the exterior surface and is directed toward the cylinder. An oil gallery is located in the block and intersects the bore. A nozzle having an end received within the bore and a jet directed toward the cylinder is provided. The nozzle includes a passage extending from the jet to the oil gallery and means are provided for securing and orienting the nozzle on the block and including a retainer releasably secured to the interior surface and having a portion overlying the bore. Interengaging means are located on the portion and the nozzle and for fixing the nozzle and the retainer against relative rotation and means extend through the portion into the nozzle and for fixing the nozzle against longitudinal movement relative to the retainer.

In a highly preferred embodiment of an engine made according to the invention as described in the preceding paragraph, the nozzle end is secured to the retainer by a bolt extending through the retainer and on the exterior of the block while the retainer is similarly secured to the block by an external bolt to facilitate servicing.

According to still another facet of the invention, there is provided a reciprocating engine including a block having at least one cylinder therein with a piston reciprocally received in the cylinder. A bore extends through the block and is directed toward the cylinder. An oil gallery is located in the block and intersects the bore and a nozzle having an end received in the bore and a jet directed towards the cylinder is provided. The nozzle includes a passage extending from the jet to the oil gallery and includes filter means for filtering oil from the gallery including ports in the nozzle extending from the passage to the gallery with each port having a cross sectional area less than that of the passage and the jet.

Other objects and advantages will become apparent from the following specification taken in connection with the accompanying drawings.

DESCRIPTION OF THE PREFERRED EMBODIMENT

Figures 1, 2:
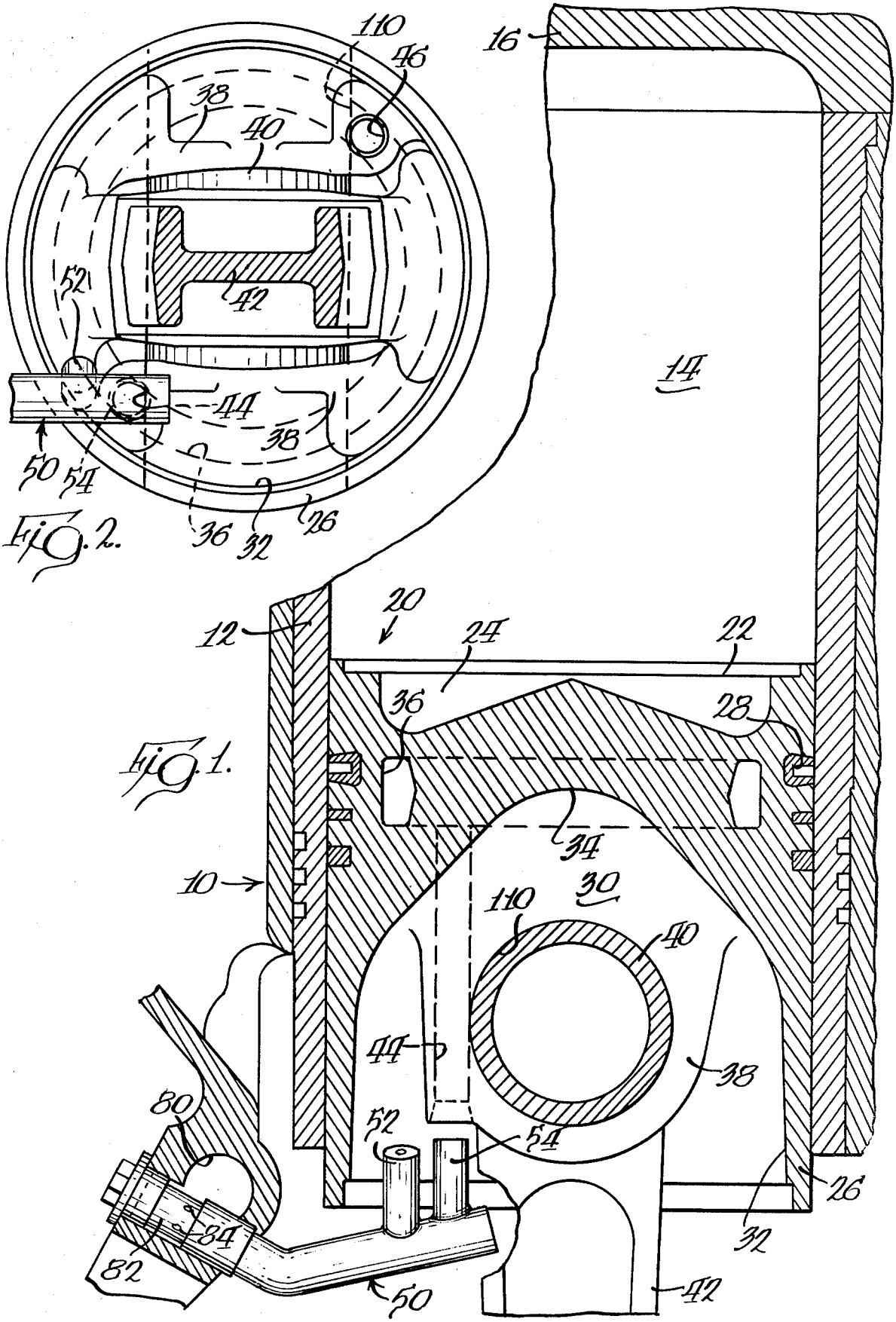
FIG. 1 is a sectional view of a reciprocating engine embodying the invention.
FIG. 2 is a bottom view of one cylinder of the engine with a piston disposed therein.

An exemplary embodiment of a reciprocating engine made according to the invention is illustrated in FIG. 1 and is seen to include an engine block, generally designated 10, receiving a cylinder liner 12 to define a cylinder 14. The upper end of the cylinder 14 is closed in a conventional fashion by a head 16 and a piston, generally designated 20, is reciprocally disposed within the cylinder 14.

The piston 20 includes an upper crown 22 provided with a conventional crater 24. Depending from the crown 22 is a skirt 26 and the skirt 26, in the vicinity of the crown 22 is provided with seal or ring-receiving grooves 28. The piston 20 includes an interior cavity 30 defined by side walls 32 in the skirt and a top wall 34 adjacent the crown 22.

In close proximity to the grooves 28 is an annular, coolant-receiving chamber 36.

Within the cavity 30 are depending, wrist pin receiving bosses 38 which receive a wrist pin 40 by which a connecting rod 42 is journalled to the piston 20. One of the bosses 38 includes an upwardly extending coolant inlet 44 by which coolant in the form of oil may be directed to the annular passage 36. Approximately 180° about the piston 20 from the inlet 44 is a similar passage 46 (FIG. 2) in the other boss 38 through which oil can drain from the passage 36.

Mounted in the block 10 at a location just below the lower end of the cylinder liner 12 is a nozzle, generally designated 50, having first and second jets 52 and 54. The jet 52 is adapted to spray a coolant, such as lubricating oil, into the cavity 30 in a manner to be described in greater detail hereinafter, while the second jet 54 is aligned with the inlet 44 to direct coolant therethrough to the passage 36.

In order to ensure that adequate coolant is directed to the passage 36 for all positions of the piston 20 within the cylinder 14, the second jet 54 is configured, as will be described, to direct a column of coolant along a line generally parallel to the longitudinal axis of the piston 20 and the inlet 44 is similarly oriented with respect to that axis.

As can seen from any of FIGS. 1–5, inclusive, the first jet 52 is disposed at an acute angle with respect to the jet 54 and therefore is at an acute angle with respect to the longitudinal axis of the piston 20. The first jet 52 is also radially outwardly of the second jet 54 with respect to the cylinder 14 and therefore is located nearer to the side wall 32 of the cavity 30. As a consequence of the foregoing construction, coolant emanating from the first jet 52 will sweep in a somewhat spiral-like pattern upwardly and along the side wall 32 to the end 34 of the cavity 30. Because the coolant spray is directed along the side wall 32, the presence of the bosses 38, the wrist pin 40, or the connecting rod 42, does not interfere with free flow thereof to the end 34 of the cavity 30, thereby preventing interference with cooling action at various points in the operating cycle.

The particular acute angle utilized will depend in a large part upon the length of the stroke of the engine and the actual disposition of the jets 52 and 54 with respect to the piston when at bottom dead center as shown in FIG. 1. In general, the longer the stroke of the engine, the lesser the angle. In an engine configured along the lines of the scale illustrated in FIG. 1, one acute angle that has proved to be satisfactory is about 19°.

Figure 3:
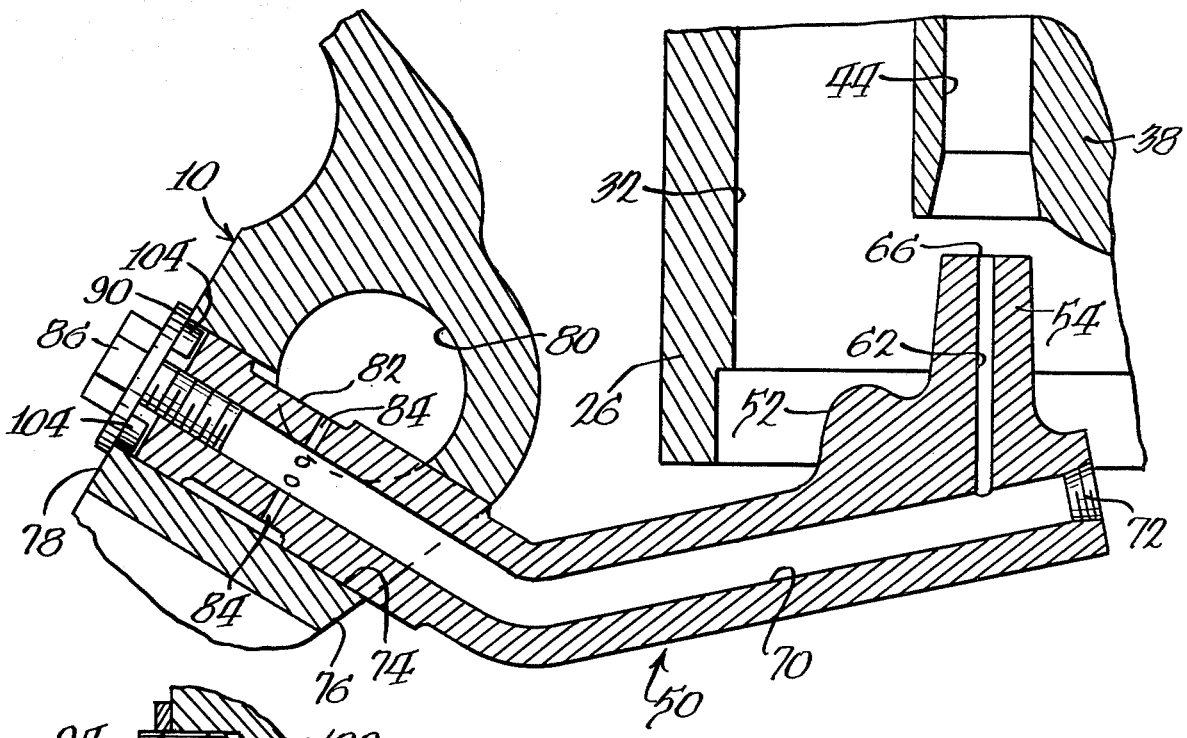
FIG. 3 is an enlarged, sectional view of part of the engine.
Figure 4:
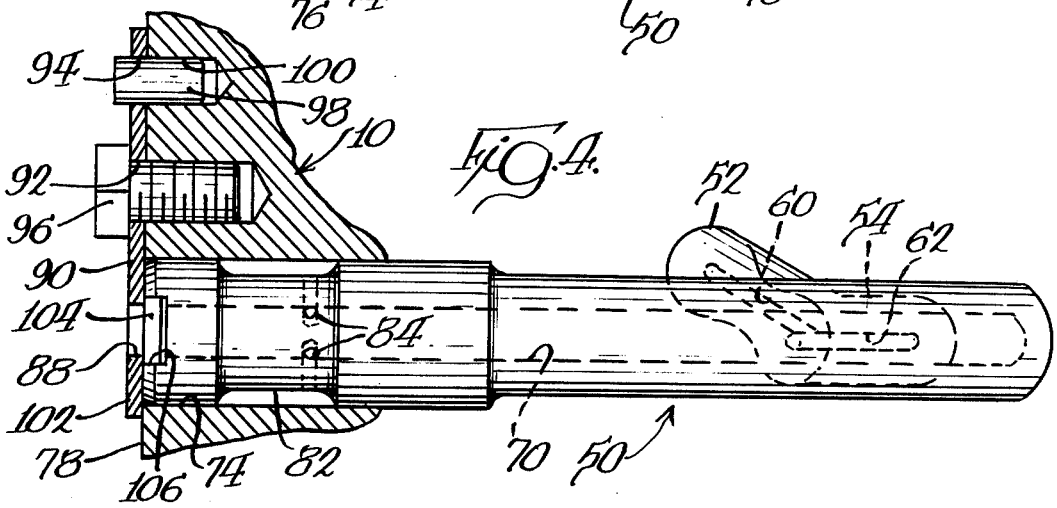
FIG. 4 is an enlarged view of a nozzle.
Figure 5:
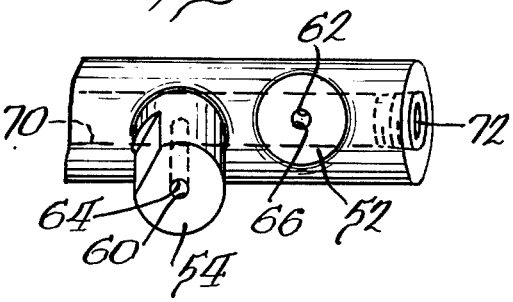
FIG. 5 is a fragmentary, plan view of jets on the nozzle.

Referring to FIGS. 3–5, each of the jets 52 and 54 is seen to be defined by a straight line bore 60 and 62, respectively. The bores 60 and 62 terminate in orifices 64 and 66, respectively, which are in planes perpendicular to the axis of the respective bore. In addition, each bore 60 and 62 has an identical cross-sectional configuration along its length and its length to diameter ratio at the orifice 64 or 66 is in the range of 13:1 to 15:1. Consequently, a highly directionalized column of coolant will emanate from each orifice 60 and 62 to ensure that it will not break up before it impinge on the appropriate part of the piston 20, as explained earlier, to cool the same.

The nozzle 50 including the jets 52 and 54 are integrally formed from an elbow-shaped casting, as illustrated in FIGS. 1 and 3, and a passage 70 extends the length of the same. The end of the passage 70 adjacent the jets 52 and 54 receives a plug 72. The opposite end of the nozzle 50 is received in a bore 74 in the block 10 which extends from the interior wall 76 of the block 10 to the exterior wall 78 thereof. The bore 74 is directed towards the cylinder and somewhat downwardly, as illustrated. Generally, the same will be located slightly below the lowermost extremity of the cylinder liner 12.

The block 10 includes an oil gallery 80 which receives oil under pressure from the engine oil pump (not shown) and which intersects the bore 74. The nozzle 50 includes a reduced diameter section 82 adjacent its end received in the bore 74 and a plurality of radially extending ports 84 emerge at the reduced diameter section 82 and are in fluid communication with the passage 70. It is to be observed that the cross sectional area of the ports 84 is less than that of either the passage 70 or the bores 60 and 62. As a consequence, the ports 84 define a filter which prevents particles entrained within the oil of a size sufficiently large to plug either the bore 60 or the bore 62 from being directed thereto. The use of a plurality of the ports 84 ensures that adequate oil under pressure will be delivered to the jets 52 and 54 even though one or more of the parts 84 becomes clogged by such particles.

The nozzle 50 is secured to the block 10 by means of a bolt 86 threaded into the end of the passage 70 adjacent the gallery 80, the bolt 86 also serving to seal that end of the passage.

Figure 6:
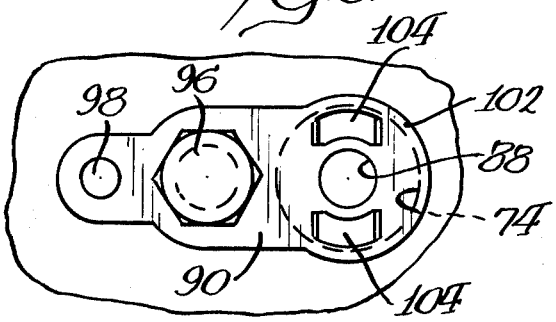
FIG. 6 is an elevation of a part of the exterior of the engine block illustrating a retainer for the nozzle.

As seen in FIG. 3, the head of the bolt 86 is on the exterior surface 78 of the block 10 and is therefore readily accessible. The same extends through an aperture 88 in a retaining plate 90 (FIG. 6). As seen in FIG. 4, the retaining plate 90 includes two additional apertures 92 and 94 for a total of three in all. A bolt 96 extends through the aperture 92 to be threadably received within the block 10 to hold the retaining plate 90 in place while the aperture 94 mounts a retaining pin 98 which is slidably received in a bore 100 in the block 10. The locating pin 98 and the bolt 96 properly orient the retainer plate 90 on the block for purposes to be seen.

As illustrated in FIGS. 3, 4 and 6, the retainer plate 90 includes a portion 102 which overlies the bore 74 and the portion 102 is provided with two, opposed tabs 104 struck from the plate 90 on opposite sides of the aperture 88. The tabs 104 extend inwardly into the bore 74 to be received in a slot 106 in the end of the nozzle 50 received within the bore 74. The tabs 104 are sized to be snugly received within the slot 106 to prevent relative rotation between the retainer plate 90 and the nozzle 50. And because the location of the retainer plate 90 on the block is accurately determined by the locating pin 98, the tabs 104 serve to properly orient the jets 52 and 54 so that they direct their respective coolant sprays in the manner mentioned previously.

Thus, the nozzle 50 is easily, properly positioned upon initial installation. It will also be recognized that the above-described structure allows easy servicing of the nozzle 50. It is only necessary to remove the side cover for the engine and the bolt 86. At that time, the nozzle 50 may be easily extracted from the bore 74 for such servicing as may be required. Reinstallation is similarly simplified since the nozzle 50 need only have its end inserted into the bore 74 and rotated until the tabs 104 enter the slot 106. The bolt 86 may then be applied and tightened with the consequence that the angular positions of the jets 52 and 54 as well as their radial positions will be properly fixed.

A further advantage of the invention is illustrated in FIGS. 1 and 2 wherein it can be seen that inlet 44 and outlet 46 to the passage 36 intersect respective ends of a bore 110 in the bosset 36 and in which the wrist pin 40 is received. Thus the oil coolant in the inlet 44 and outlet 46 also serves to lubricate the wrist pin 40.

The embodiments of the invention in which an exclusive property or privilege is claimed are defined as follows:

1. A reciprocating engine comprising:

a block having an exterior surface and at least one cylinder therein;

a piston reciprocally received within said cylinder;

a bore extending through said block from said exterior surface and directed toward said cylinder;

an oil gallery in said block and intersecting said bore;

a nozzle having an end received in said bore and having a jet directed toward said cylinder, said nozzle including a passage extending from said jet to said oil gallery; and filter means for filtering oil from said gallery comprising ports in said nozzle extending from said passage to said gallery and each having a cross-sectional area less than that of said passage and said jet.

2. The engine of claim 1 wherein said nozzle includes a reduced diameter section received in said bore and aligned with said gallery, and said ports are generally radially extending and emerge in said reduced diameter section.

3. A reciprocating engine comprising:

a block having an exterior surface and at least one cylinder therein;

a piston reciprocally received within said cylinder;

a bore extending through said block from said exterior surface and directed toward said cylinder;

an oil gallery in said block and intersecting said bore;

a nozzle having an end received in said bore and having a jet directed toward said cylinder, said nozzle including a passage extending from said jet to said oil gallery;

means for securing and orienting said nozzle on said block including a retainer releasably secured to said exterior surface and having a portion overlying said bore;

interengaging means on said portion and said nozzle end for fixing said nozzle and said retainer against relative rotation; and means extending through said portion and into said nozzle end for fixing said nozzle against longitudinal movement relative to said retainer.

4. The engine of claim 3 wherein said interengaging means comprise a slot on one of said portion and said nozzle end and a tab on the other of said portion and said nozzle end and received in said slot.

5. The engine of claim 4 wherein said retainer comprises a plate having two apertures, one aperture being located in said portion, there being two said tabs, both located on said portion about said one aperture, said means extending through said portion comprising a bolt extending through said one aperture and threaded into said nozzle end; and further including a bolt threaded into said block through the other aperture, and a locating pin mounted on said plate and extending into a bore in said block.

6. A reciprocating engine comprising:

a block having at least one cylinder therein;

a piston reciprocally received in said cylinder and having a crown, depending skirt, and a ring-receiver groove on said skirt near said crown, said piston having a central cavity terminating near said crown and coolant-receiving means in heat exchange relationship to said groove;

a nozzle stationarily mounted on said engine having first and second jets, said first jet being directed to shoot coolant to said cavity and said second jet being directed to shoot coolant to said coolant-receiving means, both for all operating positions of said piston within said cylinder;

means for supplying oil to said nozzle to act as a coolant;

said oil supplying means comprising an oil gallery in said block and said nozzle comprising a body having an internal passage connected to said jets, said body being mounted in said block and having a plurality of generally radially extending ports extending from said internal passage to said gallery, each of said ports having a smaller cross-sectional area than said passage and said jets to thereby define a filtering means.

* * * * *